US006098634A

United States Patent [19]

Nilo et al.

[11] Patent Number: 6,098,634

[45] Date of Patent: Aug. 8, 2000

[54] BEAUTY COIL AND METHOD

[75] Inventors: Gary Nilo, Weston, Fla.; James Dennis Cotton, Marietta, Ga.; Annette Snow Ludolf, Winston-Salem, N.C.; John T. Delanty, Bedford, N.H.

[73] Assignee: Little Rapids Corporation, GreenBay, Wis.

[21] Appl. No.: 09/127,019

[22] Filed: Jul. 31, 1998

[51] Int. Cl.[7] ..... A45D 19/00

[52] U.S. Cl. ..... 132/200; 132/212; 132/319

[58] Field of Search ..... 132/221, 223, 132/226, 200, 270, 319, 212; 604/330, 328, 904; 206/363, 440; 229/87.05, 926, 940

[56] References Cited

U.S. PATENT DOCUMENTS

| | | | |
|---|---|---|---|
| 652,370 | 6/1900 | Murphy | 229/87.05 |
| 1,094,427 | 4/1914 | Cook | 229/940 |
| 2,079,328 | 5/1937 | McBean . | |
| 2,097,328 | 5/1937 | Mc Bean | 229/87.05 |
| 2,139,436 | 12/1938 | Beck | 132/221 |
| 2,582,992 | 1/1952 | Hergert | 229/926 |
| 2,587,515 | 2/1952 | Parish | 229/87.05 |
| 2,906,273 | 9/1959 | Beauregard | 132/221 |
| 3,092,251 | 6/1963 | Jaggers | 229/926 |
| 3,278,013 | 10/1966 | Banks . | |
| 3,642,564 | 2/1972 | Walker et al. | 229/926 |
| 4,170,305 | 10/1979 | Hull, Jr. et al. | 206/440 |
| 4,762,230 | 8/1988 | Croce | 229/940 |

*Primary Examiner*—Todd E. Manahan
*Attorney, Agent, or Firm*—Niro, Scavone, Haller & Niro

[57] ABSTRACT

A beauty coil that is in the form of a rod which is comprised of a mass of continuous fibers which run the length of the rod. The fibers are held in a compressed state by an outer sheathing, which when removed, allows the fiber mass to expand or blossom prior to use.

11 Claims, 5 Drawing Sheets

BEAUTY COIL AND METHOD

BACKGROUND OF THE INVENTION

The device of the present invention relates to a beauty coil product that provides an individual protection from exposure to chemicals used during a perm process or other beauty salon treatments or processes involving chemical applications. More specifically, the invention relates to improvements for a pre-formed beauty coil having a sheath to maintain a plurality of elongated fibers which form a tubular mass in a compressed state.

SUMMARY OF THE INVENTION

The present invention relates to improvements in a pre-formed beauty coil that provides comparable absorbency and additional strength over currently available beauty coil products. The beauty coil of the present invention consists of a beauty coil having a plurality of elongated and continuous cellulose acetate fibers that are bundled together to form a tubular mass that is wrapped and held in a compressed state by an outer sheathing. Once the sheathing is removed, the compressed fiber mass expands increasing the volume of the fiber mass and provides an absorbent product. Moreover, packaging the beauty coil in a compressed state reduces the volume occupied by the product, thus, lowering shipping, packaging and other associated costs.

To facilitate removal of the sheathing for use, a tear-strip may be located between the cellulose acetate and sheathing. Moreover, the sheathing may be perforated as well to facilitate its removal.

Thus, an object of the present invention is to provide a beauty coil product that has superior strength as compared to currently available beauty coils.

Another object of the present invention is to provide a beauty coil product in which the outer sheath may be easily removed through the use of a tear-strip or perforations.

Still another object of the invention is to provide a beauty coil that is shipped and packaged in a compressed state and later expands upon use, thereby lowering the cost of shipping, packaging and handling of the product without limiting the absorbency of the device.

DESCRIPTION OF THE PREFERRED EMBODIMENT

Figure 1:
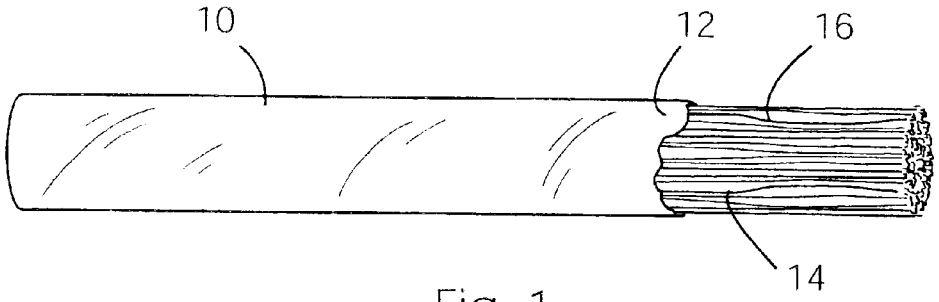
FIG. 1 is a perspective view of the present invention with portions removed to reveal the continuous fibers.

As shown in FIG. 1, a beauty coil or rod 10 is provided which is comprised of an outer sheathing 12 and a plurality of continuous fibers 14 that are enclosed within sheath 12 to form a fiber mass 16.

In a preferred embodiment, the elongated and continuous fibers 14 may be made from a cellulose acetate tow. However, other continuous fibers such as rayon, nylon, polyester, polypropylene and the like may be used. The preferred acetate tow has a denier per filament in the range of 1.5 to 10.0, preferably 2.7 and a total denier in the range of 15,000 to 80,000, preferably 32,000. Sheath 12 may be made from a non-porous paper or similar material. The preferred paper has a weight of about 27 grams per square meter with a caliper of about 0.0390 mm.

Using continuous cellulose acetate fibers that run the length of the coil has many advantages over present beauty coils which do not use fibers which run the length of the coil. It has been found that the continuous fibers of the present invention create a beauty coil that appears to as absorbent as currently available beauty coils. In addition, because the fibers run the length of the product, the fiber's ability to resist separation from the fiber mass is enhanced which increases the coil's overall strength.

A manufacturing source of the beauty coil of the present invention is the R.J. Reynolds Tobacco Company of Winston-Salem, N.C. As generally understood, the beauty coil of the present invention is manufactured using a modified KDF filter maker which includes a tear-strip supply and a cutter to cut the rods into selected lengths. A monofilament tow, such as cellulose acetate, is drawn into a chamber where the fibers are separated or bloomed to a predetermined bulk density. Afterward, enhancements such as anti-slippage agents, fragrance, talc or other useful additions may be added to the fibers. Next, the fibers are forced into a garniture where the fibers are compacted or compressed to reduce the diameter of the fiber mass and the fiber mass is then wrapped in sheath 12 which holds the fiber mass in a compressed state. Then, the rods are cut to a predetermined length. The resulting rods may be cut to lengths of about 25 to 36 inches for optimal end use.

It has been found that a fiber mass that is about 20 millimeters in diameter may be compressed and reduced, as described above, into a fiber mass that is about 7 to 8 millimeters in diameter. This reduction in volume of the fiber mass typically reduces the volume of the beauty coil by about 70–85% which, in turn, reduces associated shipping, packaging and other handling costs such as storage and the like. This cost savings is particularly important with respect to beauty coil products since the products are relatively light in weight yet occupy a relatively high volume of space.

Figure 2:
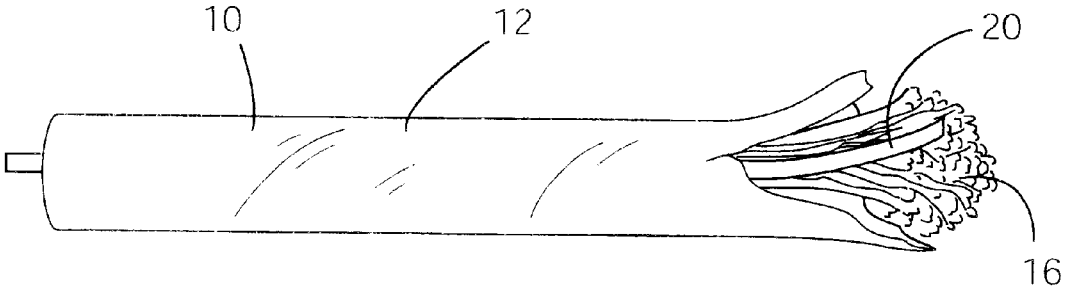
FIG. 2 is a perspective view of an embodiment employing a tear-strip to facilitate removal of the outer sheath.
Figure 3:
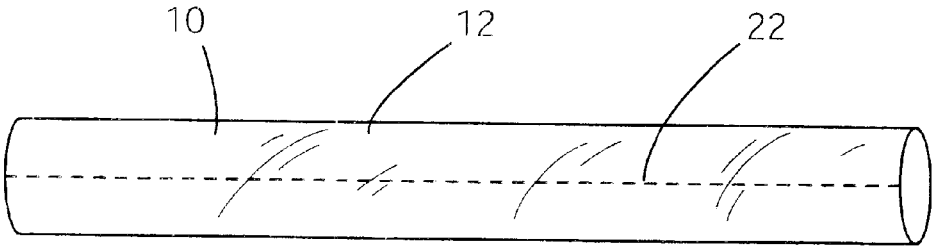
FIG. 3 is a perspective view of the embodiment employing perforations to facilitate removal of the outer sheath.

To assist in the removal of the sheath 12 prior to use, a tear-strip 20 may be provided. As shown in FIG. 2, tear-strip 20 is located between sheath 12 and fiber mass 16 and extends longitudinally along the length of said rod. Tear-strip 20 may be made from a polyester and may also be colored for ease of visibility. In addition, as shown in FIG. 3, perforations 22 may be provided along the length of the rod which also assists in the removal of sheath 12.

Figure 4:
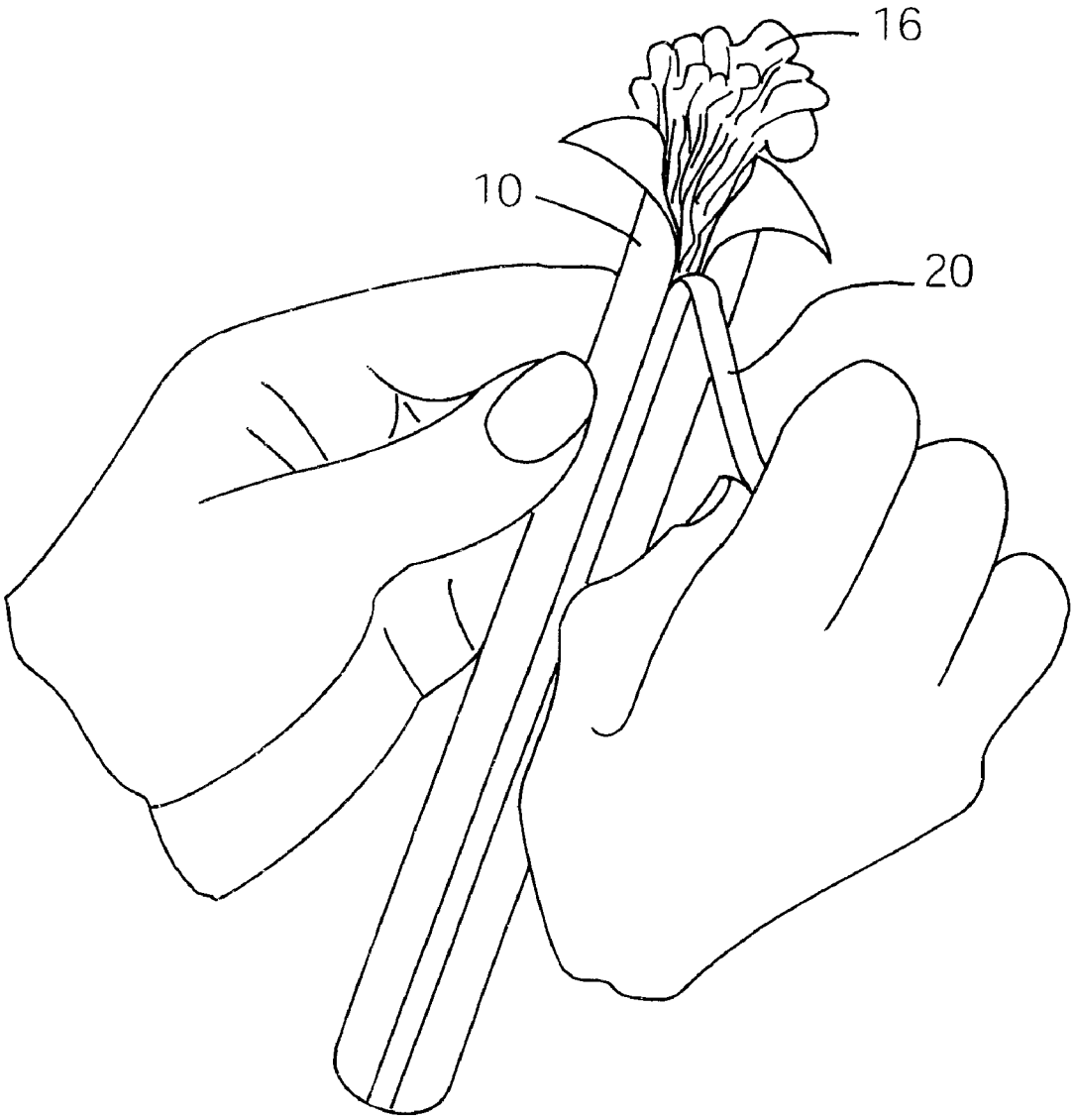
FIG. 4 is a perspective view showing how the tear-strip is employed.
Figure 5:
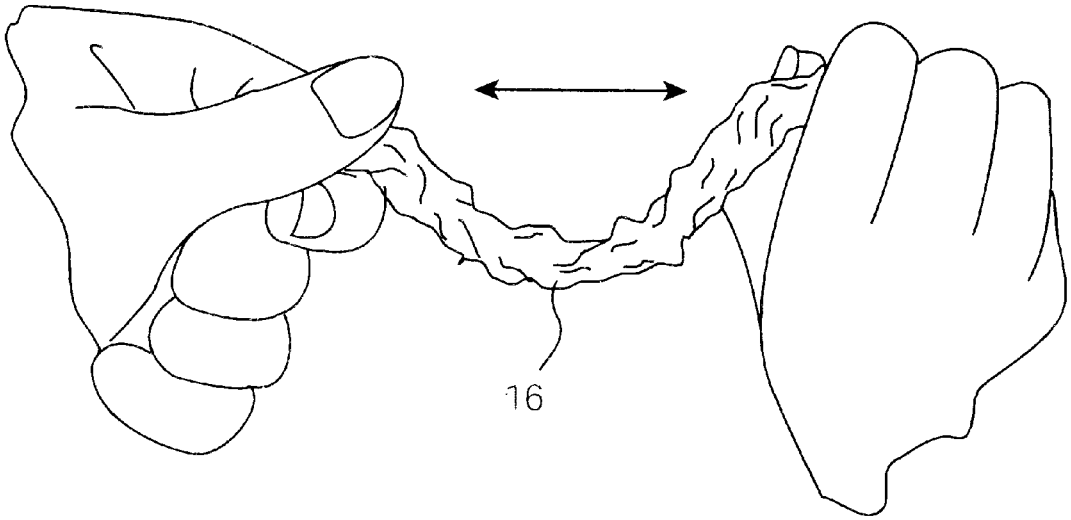
FIG. 5 is a perspective view showing how the fibers are fluffed or blossomed after removal of the sheath.
Figure 6:
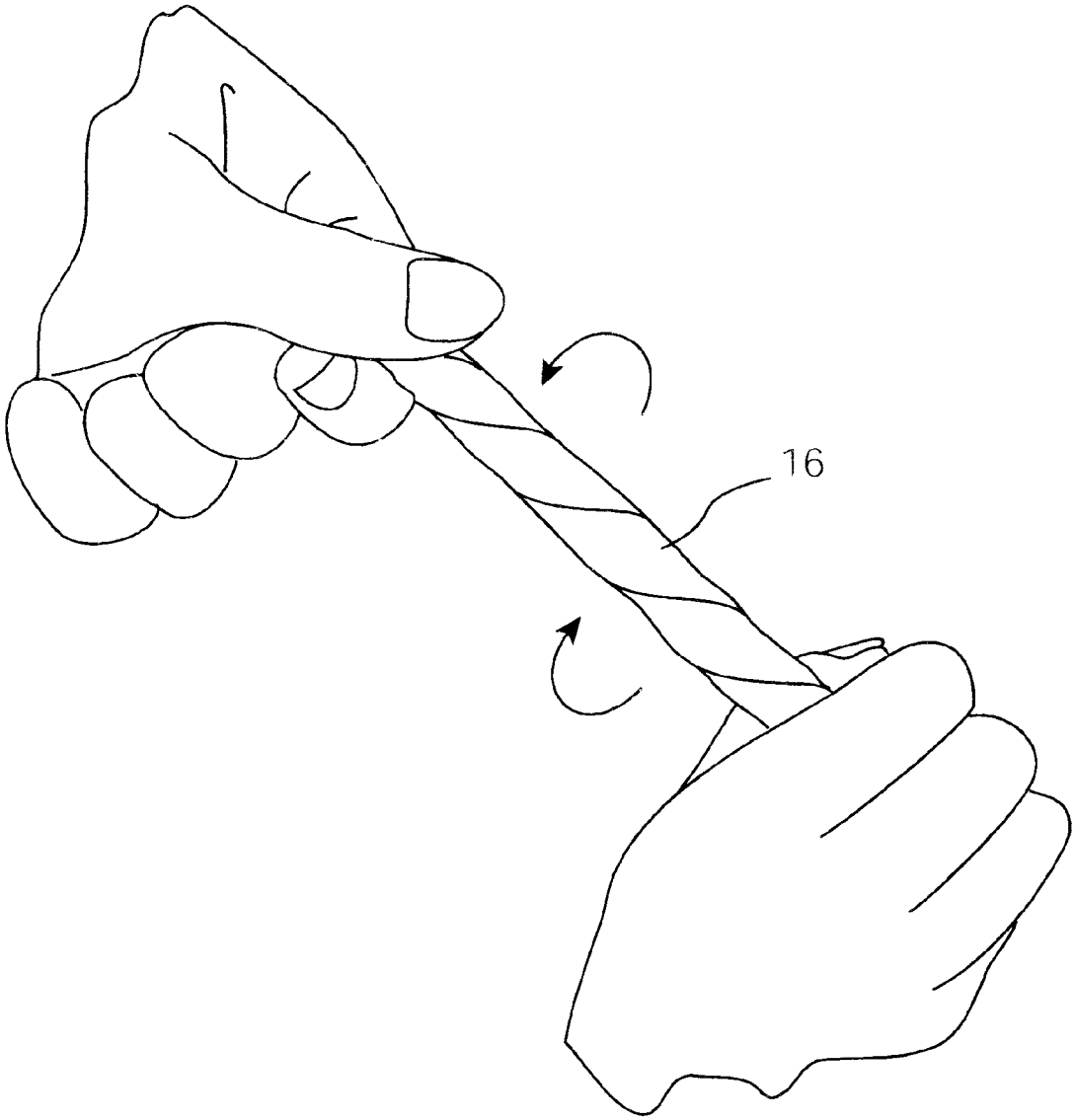
FIG. 6 is a perspective view showing how the coil is to be twisted prior to use.
Figure 7:
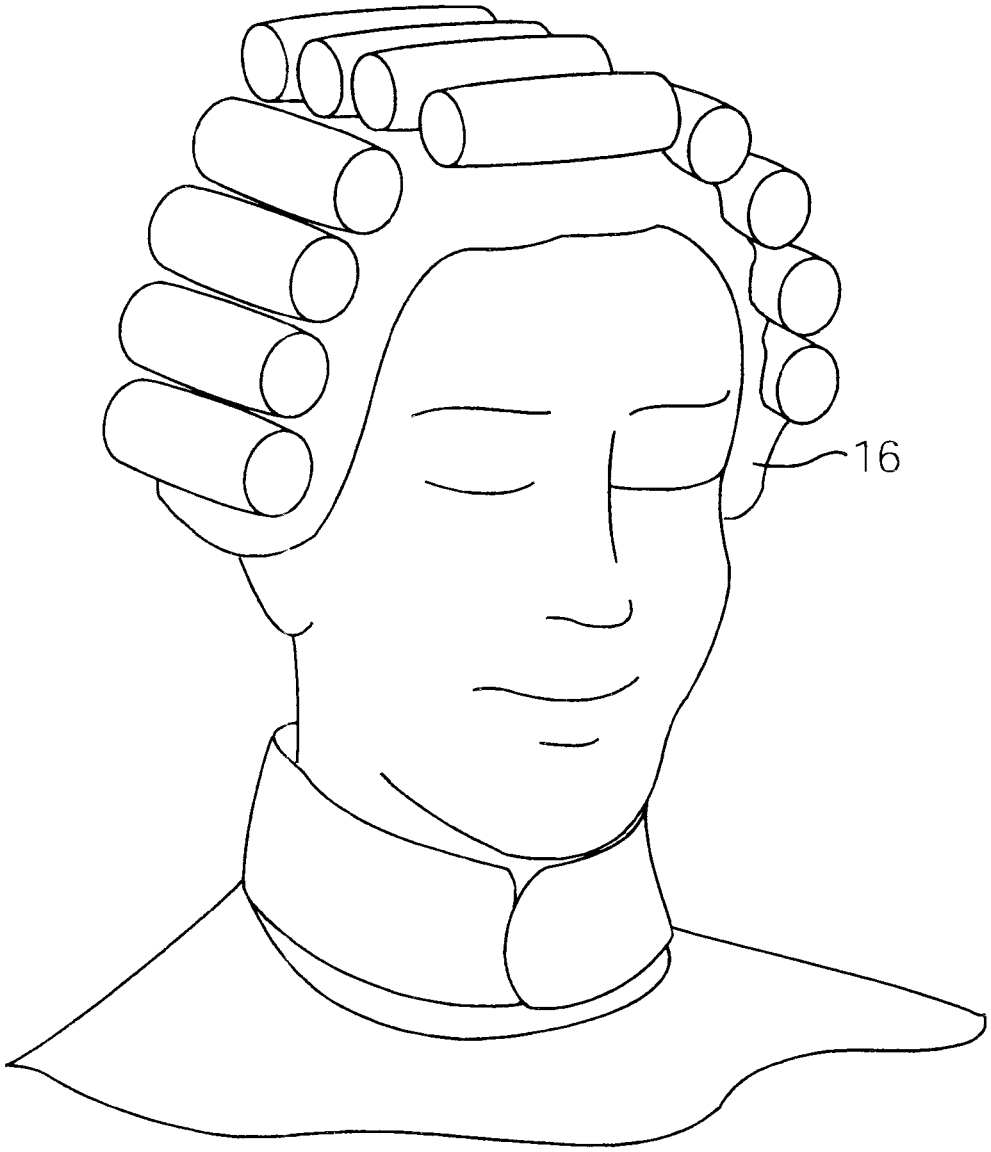
FIG. 7 is perspective view showing the beauty coil in use.

In use, pre-cutting the rods to a predetermined length eliminates the waste associated with endless length beauty coil type products which are currently available. After a stylist selects a rod or coil for use, the sheath is removed as shown in FIG. 4 and the fibers are then expanded by both a pulling and twisting action as shown in FIGS. 5 and 6. After the fibers are expanded, the rod is placed into position so that the fibers form a liquid absorbent barrier to protect an individual from exposure to chemicals used in a beauty treatment as shown in FIG. 7.

To assist the stylist in the removal of sheath 12, tear-tape 20 is pulled down the length of the rod to rip open the sheath as shown in FIG. 4. As stated above, removal of the outer sheath allows the compressed fibers to blossom or expand. Providing a tear-tape enhances the ease of the coil's use since it has been found that removal of the sheathing may be a difficult and time consuming process.

It is understood that various changes and modifications to the preferred embodiments described herein would be apparent to one skilled in the art. Changes and modifications can be made without departing from the spirit and scope of the present invention and without diminishing its intended advantages. It is, therefore, intended that such changes and modifications be covered by the following claims.

What is claimed is:

1. A beauty coil comprising:

a rod pre-cut to a pre-determined length for application to a person's head, said rod having opposing ends and comprised of a plurality of liquid absorbent fibers, each of said fibers extends the length of said rod from end to end to form a cylindrical fiber mass;

said fiber mass held in a compressed state; and a sheath which holds said fiber mass in said compressed state until removal of said sheath whereby said fiber mass is allowed to expand while maintaining said cylindrical shape of said fiber mass.

2. The beauty coil of claim 1 wherein said fibers are a cellulose acetate.

3. The beauty coil of claim 1 wherein each fiber is about 2.7 in denier.

4. The device of claim 1 wherein the total denier of said fiber mass is about 32,000.

5. The device of claim 1 further including a tear-tape located between said fiber mass and said sheath.

6. The device of claim 1 wherein said sheath includes perforations located along the length of said rod.

7. The device of claim 1 wherein said fibers are compressed to a diameter of approximately 7 to 8 millimeters and said fiber mass expands to a diameter of about 20 millimeters.

8. A method for using a cylindrical absorbent fiber mass to protect a person's face from exposure to permanent solutions comprising the steps of:

placing a cylindrical rod of absorbent material around the head of a person in close proximity to the person's hair line;

said rod comprised of a plurality of liquid absorbent fibers, each of said fibers extend the entire length of said rod; and using said rod to absorb permanent solutions.

9. The device of claim 8 wherein said rod is cut to a predetermined length prior to use.

10. The device of claim 8 wherein said fibers are made of cellulose acetate.

11. The device of claim 8 wherein prior to use, said cylindrical rod is held in a compressed state by a sheath and removal of said sheath permits the diameter of said cylindrical fiber mass to expand.

* * * * *